US006867673B2

(12) United States Patent
Minami et al.

(10) Patent No.: US 6,867,673 B2
(45) Date of Patent: Mar. 15, 2005

(54) SOCKET FOR LAMP, TRANSFORMER FOR LAMP AND METHOD OF MANUFACTURING TRANSFORMER FOR LAMP

(75) Inventors: Fumihiro Minami, Tokyo (JP); Mutsuo Sekiya, Tokyo (JP); Masaru Kibi, Osaka (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 84 days.

(21) Appl. No.: 10/110,689

(22) PCT Filed: Aug. 17, 2001

(86) PCT No.: PCT/JP01/07096

§ 371 (c)(1),
(2), (4) Date: Apr. 17, 2002

(87) PCT Pub. No.: WO02/16825

PCT Pub. Date: Feb. 28, 2002

(65) Prior Publication Data

US 2002/0171527 A1 Nov. 21, 2002

(30) Foreign Application Priority Data

Aug. 18, 2000 (JP) ..... 2000-248159

(51) Int. Cl.[7] ..... H01F 27/04
(52) U.S. Cl. ..... 336/107; 336/192; 336/198
(58) Field of Search ..... 336/90, 92, 107, 336/192, 198; 439/230, 336; 315/70, 141, 212, 274, 276, 354, 57

(56) References Cited

U.S. PATENT DOCUMENTS 5,600,208 A * 2/1997 Katou et al. ..... 315/70
5,959,521 A * 9/1999 Kohmura et al. ..... 336/198
6,290,526 B1 9/2001 Minami et al.

FOREIGN PATENT DOCUMENTS

JP 3-136938 6/1991
JP 7-114805 5/1995
JP 8-315631 11/1996

* cited by examiner

*Primary Examiner*—Tuyen T. Nguyen
(74) *Attorney, Agent, or Firm*—Sughrue Mion, PLLC

(57) ABSTRACT

Providing a high-voltage-side terminal with means for preventing a core inserted into a central hole of a bobbin from getting out of position securely fixes the core to the predetermined position, at the time a transformer which is a part of an ignitor is assembled, during the work proceeds from the inserting step of the core to the next step. Thus, at the time the ignitor-integral type bulb socket is assembled, the core hardly moves out of the predetermined position and there is a less possibility that the core gets out of position. Accordingly, this does not require so high machining accuracy of both members and reduces the cost for machining the product as well as for inspecting the dimension control or the like.

8 Claims, 19 Drawing Sheets

SOCKET FOR LAMP, TRANSFORMER FOR LAMP AND METHOD OF MANUFACTURING TRANSFORMER FOR LAMP

TECHNICAL FIELD

This invention relates to a socket for a lamp (a lamp socket), a transformer for use in the lamp (a lamp transformer) to be used as a headlight of a mobile body such as a motor vehicle or for household lighting, and also to a method of manufacturing the lamp transformer.

BACKGROUND ART

Conventionally, among discharge lamps, a high-intensity discharge (HID) lamps such as a metal halide lamp, a high-pressure sodium lamp, a mercury lamp, or the like has been used as a lamp or a street lamp in outdoor facilities, warehouses, factories, or the like because it has such advantages as a large luminous flux, a higher lamp efficiency, and a long lifetime. Particularly, they have recently come to be used as headlamps for vehicles such as motor vehicles. In order to light this kind of discharge lamp, it is necessary to apply a high starting voltage at the time of starting up. Therefore, aside from a stabilizer for continuously lighting the discharge lamp, an igniting device with an ignitor is required to generate the starting voltage.

FIGS. 1 and 2 are drawings for explaining an igniting device of a conventional HID headlamp for a motor vehicle. FIG. 1 shows a vertical sectional view of the igniting device seen from one side of the motor vehicle. FIG. 2 is a schematic view of a transformer of an ignitor.

In FIGS. 1 and 2, reference numeral 1 denotes a housing of an HID headlamp containing therein an HID lamp. Inside this housing 1, there is attached a reflector 2 which functions as a reflecting mirror for controlling the light radiated by the HID lamp and projecting forward ahead of the vehicle. A mirror surface, which serves as a reflecting surface, is coated on an inner surface of the reflector 2. At a substantially central portion of this reflector 2, there is mounted an HID bulb 4 held in position by the housing 1 through insertion into a bulb socket 3. An ignitor 5 which generates a high voltage (e.g., 30 KV) for lighting the HID bulb 4 is separately provided out of the housing 1. A transformer 6, which is a component of the ignitor 5 and generates a high voltage, is contained inside the ignitor 5.

A power control circuit (ballast) 7 for performing an ignition control (lighting-on control after ignition) of the HID lighting device is provided integrally with, or separated from, one or both of the ignitor 5 and the transformer 6. In FIG. 1, the ignitor 5 is contained inside the housing of the ballast 7. The HID lighting device thus configured applies instantaneously a high voltage to the HID bulb 4 to thereby cause dielectric breakdown between electrodes inside the HID bulb 4. A high-voltage discharge is given rise to, and a gas filled inside the bulb is illuminated. Reference numeral 8 denotes a lens through which the luminous flux of the HID bulb disperses within a predetermined range to irradiate ahead of the vehicle, thereby securing safety of the vehicle while it is running in the dark.

The housing 1 of the HID headlamp is usually placed, as shown in FIG. 1, in a space between a bumper 9*a* in a front portion 9 of the vehicle and an engine hood 9*b*. In this kind of conventional HID lighting device, the ignitor 5 for generating a high voltage and the power control circuit (ballast) 7 for controlling the power supply to the HID lighting device are configured and mounted separately from the housing 1. Therefore, the power supply to the bulb socket 3 is done through a harness 10.

In addition, the wiring of the ignitor 5 for generating a high voltage, i.e., a transformer 6, is configured as shown in FIG. 2. This high-voltage generating transformer 6 is made up of a columnar core 12 provided in the central portion of the transformer 6, a primary winding 13 which is wound around the core 12, a secondary winding 14 which is wound around the outside of the primary winding 13, and an insulating member 15 for electrically insulating the space between the secondary winding 14 and the primary winding 13.

In the above structure, since the ignitor 5 and the bulb socket 3 are provided separately from each other, it is necessary to connect them together with the harness 10. In order to shield the radio waves leaked out from the harness 10, the harness 10 must be covered with a high-performance shielded wire. In addition, in order to completely remove the influence of the leaked radio waves on a car radio, or the like, by covering the housing 10 with a radio shield wire, it had to use a costly radio shield wire.

In order to solve this kind of problems, it is effective in disposing the high-voltage portion inside the lamp device and shielding the inside of the lamp device by means of metallic thin film vapor deposition process, or the like from the radio waves. As an approach, there has conventionally been devised to integrally mount the ignitor portion for generating a high voltage and the HID bulb together. For example, JP 136938/1991 A discloses a structure in which a bulb socket for receiving therein an HID bulb and an ignitor are annexed on the same substrate and houses them inside a housing.

In JP 136938/1991 A, the ignitor and a discharge gap are assembled into the substrate on which the HID bulb is mounted. However, no electrical insulation is provided on a high-voltage portion of the ignitor. For example, in case an electrical insulating measure is taken, e.g., by completely coating the electronic parts mounted on the substrate and the ignitor with a resin, the HID bulb will be totally integrated to an extent that the HID bulb is indistinguishable from the electronic parts inclusive of the ignitor. Where the ignitor is integrated in this manner, it becomes necessary to replace the entire bulb assembly in replacing the lamp due to a trouble with the HID lamp itself, or to the lifetime thereof, or the like. There was, therefore, a disadvantage that replacement costs too much than the HID bulb.

Further, since, in the conventional apparatus, the transformer 6 for generating a high voltage in the ignitor 5 is configured, as shown in FIG. 2, such that the secondary winding 14 is provided outside the primary winding 13, the secondary winding 14 as a high-voltage generating part is placed in close proximity to the low-voltage core 12 and the primary winding 13. Thus, an electrical insulating distance against the high voltage must be left between the secondary winding 14 and its surrounding parts, as well as between the primary winding 13 and the secondary winding 14. The insulating member 15 must thus be made thick (large in width), so that a requirement for size reduction cannot be met, e.g., for a discharge lamp to be mounted on a motor vehicle.

As another approach which is able to make the HID bulb economically and reduce in size without replacing by the unit of the lamp assembly as with the above example, it is given that the ignitor 5 (inclusive of the transformer 6, the discharge gap, electronic parts, etc.) is integrally assembled onto the bulb socket 3 on which the HID bulb is mounted and retained. This kind of structure is disclosed in JP 315631/1996 A and JP 315624/1996 A in which the transformer is provided for integration on a periphery of the bulb socket, as well as in JP 114895/1995 A in which the transformer is provided for integration in an axial direction of the bulb socket.

The pending PCT Application No. PCT/JP99/02020 filed (international filing date: Apr. 15, 1999) by the same applicant of this application discloses an arrangement in which the transformer is provided in the axial direction of the bulb socket portion. In addition, JP 231948/2000 A (filed on Jul. 31, 2000) discloses a high-voltage terminal in which a transformer is integrated by providing it in an axial direction of a bulb socket portion.

As comparative examples of the present invention of this application will now be described with reference to FIGS. 3 and 4.

FIG. 3 shows an external view of a bulb socket integrally arranged with an ignitor (hereinafter called as an ignitor-integral type bulb socket) of the pending patent application filed by the same applicant of this application. FIG. 4 shows a schematic diagram of a sectional view taken along the central portion of an ignitor-integral type bulb socket for explaining a general arrangement of a transformer to be used in the ignitor-integral type bulb socket.

Reference numeral 20 denotes the ignitor-integral type bulb socket, 23 an upper case and 24 a lower case, respectively, of the ignitor-integral type socket 20, 25 a transformer which is provided inside the ignitor-integral type socket 20, 26 a bobbin formed in a resin, 27 a primary coil, 28 a secondary coil, 29 a high-voltage terminal which comes into contact with, and is connected to, a terminal of the HID bulb when the HID bulb (not shown) 21 is mounted, and 30 a guide which cylindrically projects at a circumference of the high-voltage terminal and is formed integrally with the bobbin 26. The terminal on the HID bulb 20 side is inserted into the guide 30. Reference numeral 32 denotes a low-voltage terminal which comes into contact with, and is connected to, the terminal on the low-voltage side of the HID bulb. Reference numeral 33 denotes a core which is inserted into a central portion of the bobbin 26. A capacitor for continuously lighting the HID bulb 21, the electronic circuits, the discharge gap, the transformer 25, or the like are all contained inside the housing of the ignitor-integral type bulb socket 20 which is made up of the upper case 23 and the lower case 24.

The upper and lower cases 23, 24 are filled with a resin (not shown) for the purpose of electrical insulation and waterproofing of the transformer 25, electronic circuit 34 for drive control, and other parts.

Reference numeral 25 denotes the transformer for generating a high voltage, in which the secondary coil 28 is wound around the outside of the core 33 provided in the central portion of the bobbin 26, and the primary coil 27 is wound around the outside of the secondary coil 28. A high-voltage-side output terminal 28*a* of the secondary coil 28 is connected to the terminal of the core 33, i.e., to the high-voltage terminal 29. A low-voltage-side input terminal 28*b* of the secondary coil is connected to an output terminal 27*a* of the primary coil 27, and both the terminals have the same potential.

Having taken such an arrangement, unlike the conventional one, the secondary coil 28 is provided on the inside of the primary coil 27, and the output terminal 28*a* can be used as the terminal for the core 33 at the central portion. Therefore, the secondary coil 28 will easily be mounted and the volume thereof to be electrically insulated can be minimized, reducing number of parts and size. Further, since the secondary coil 28 for generating a high voltage is centralized in the central portion of the high-voltage generating transformer 25, the distance can be left for electrical insulation from the surrounding members, thereby facilitating the electrical insulating treatment to the outside.

The ignitor-integral type bulb socket 20 having the above structure is made without taking account of the prevention of the core 33 from being dropped out of position at the time it is assembled. For example, depending on the difference in the finished dimensions between the outer diameter of the core 33 and the inner one of the central hole of the bobbin 26, the clearance between the two members sometimes may become large. As a result, it becomes difficult to retain the core 33 which serves as the core of the transformer 25, in a predetermined position of the central hole of the bobbin 26. In this case, at the time the ignitor-integral type bulb socket 20 is assembled, the core 33 is likely to move from the predetermined position and may occasionally get out of position. Therefore, in order to prevent the transformer 25 from becoming worse in performance or poor in quality, it is indispensable to make higher the finishing accuracy of both the members so that they attain a dimensional relationship corresponding to sliding fit for mechanical fitting (i.e., substantially zero clearance) For this reason, the cost for manufacturing the product and for controlling and inspecting the dimensions is greatly raised.

In addition, the high-voltage-side terminal 29 cannot be constantly and stably inserted into the bobbin 26 to a predetermined depth. For example, while the automatic stable insertion of the high-voltage-side terminal is required from the viewpoint of mass productivity of the product, in case the insertion force is large, it is applied to contact claws, resulting in an excessive deformation of the contact claws. As a consequence, there is a possibility that the retainability and the contact of the HID bulb will probably become worse. Further, in case the strength of the contact claws is high, the resin portion which acts as the seat for receiving the claws will be deformed or damaged. As a result, this forces manual insertion and precludes the improvement in the productivity.

Moreover, from necessity for insertion of the high-voltage-side terminal into, and retain at, the bobbin, and for a measure to prevent the high-voltage-side terminal 29 from getting out of position, a through hole is formed at the bottom surface of the cylindrical guide 30 for inserting thereinto the high-voltage-side terminal 29. Moreover, a guide groove (not shown) is provided at a part of the wall surface of the central hole of the bobbin 26 into which the bobbin 26 is inserted. The high-voltage terminal is thus automatically inserted into the portion, depending on the dimensional deviations in the inserting hole and the guide groove, the high-voltage terminal 29 may be exposed to serious danger that it perhaps occasionally dislocates or gets out the position after being inserted and assembled. Therefore, it will entail an additional step after assembling, thereby raising the manufacturing cost.

This invention has been made to solve the above problems and an object thereof is to provide a high-voltage terminal which prevents the core 33 from getting out of position without involving the high manufacturing and assembling accuracy of the constituent parts, which enables more stable insertion of the core 33 to the predetermined depth, and which surely prevents the high-voltage terminal 29 from getting out of position after the insertion. Another object of the present invention is to provide a method of manufacturing the transformer featuring mass-productivity, in its turn, an ignitor-integral type lamp socket which is small in size and low in cost, and a transformer for the lump, as well as a method of manufacturing the transformer.

DISCLOSURE OF INVENTION

In the lamp socket according to the present invention, since a retaining means for retaining the core is provided at a high-voltage terminal, it is possible to assemble the transformer with the core temporarily retained by the high-voltage terminal after the lamp socket has assembled. The simple arrangement prevents the core from getting out of position while being assembled, thereby improving the workability.

In the transformer for a lamp according to the present invention, since a retaining means for retaining the core is provided on the high-voltage terminal, it is possible to retain the core with a simple arrangement. This reduces size of the apparatus as well as the cost thereof.

Preferably, the core contact of the high-voltage terminal urges the core against an wall surface of the bobbin to retain the core within the bobbin. It is possible to provide the retaining means of a simple structure in the high-voltage terminal, thereby reducing size and the cost of the apparatus.

Since the core contact preferably has a projected part, the core contact can be formed by press forming or the like. It is possible to provide the core contact by a simple working, thereby improving the working efficiency.

Further, preferably, the high-voltage terminal is provided with a core retaining part which retains the core by coming into contact it with an open end surface of the core at a side where the core gets out of the bobbin.

Further, since the core retaining part preferably is a bent portion formed by bending an end of the high-voltage terminal toward the core after the high-voltage terminal and the core are assembled into the bobbin, the core can thus be easily formed by a bending work. Therefore, it is possible to reduce the size and cost of the apparatus. In addition, since the core retaining part is formed after the high-voltage terminal and the core are assembled into the bobbin, the core retaining part will not hinder the assembling work of the high-voltage terminal into the bobbin, thereby improving the workability.

Further, since, preferably, the core retaining part comprises a twisted part which is formed by twisting an end of the high-voltage terminal after the high-voltage terminal and the core into the bobbin are assembled, the core retaining part can thus be formed simply by the twisting working, it is possible to reduce size and cost. In addition, since the core retaining part is formed after the high-voltage terminal and the core are assembled into the bobbin, the core retaining part will not hinder the assembling work of the high-voltage terminal into the bobbin, thereby improving the work efficiency.

In the transformer for a lamp according to the present invention, a projected part is provided in an inserting portion into the bobbin such that a surface along an inserting direction is tapered and that a corner is provided along a surface opposite to the inserting direction. Therefore, when the high-voltage terminal is inserted into the bobbin, the tapered surface facilitates the insertion thereof and, once the high-voltage terminal has been inserted into the bobbin, the corner prevents the high-voltage terminal from being pulled out of position. The simple arrangement and steps prevent the high-voltage terminal from pulling out of the position.

The transformer for a lamp according to the present invention comprises a lamp-side contact provided on the high-voltage terminal for coming into contact it with a high-voltage-side contact of the lamp, and a contact provided on the high-voltage terminal for elongating in a direction opposite to the inserting direction of the high-voltage terminal into the bobbin. Therefore, since, at the time the high-voltage terminal is inserted into the bobbin, the contact is urged by the jig for inserting the high-voltage terminal, the lamp-side contact is prevented from being deformed without urging the lamp-side contact of the high-voltage terminal by the jig. Further, since the inserting position of the high-voltage terminal is determined by the length of the contact, it is possible to cope with requirement of the automatic insertion, and to stabilize the inserting position.

The transformer for a lamp according to the present invention comprises a coil winding provided on a high-voltage terminal so that an initial winding end of the coil can be wound around the coil winding. The simple arrangement automates the winding step of the coil.

The method of manufacturing a transformer for a lamp according to the invention involves the steps of inserting the high-voltage terminal into the bobbin; inserting the core into the bobbin in which the high-voltage terminal is inserted; winding the initial winding end of the secondary coil around the coil-winding of the high-voltage terminal; winding the secondary coil around the bobbin in which the high-voltage terminal and the core are inserted; and winding the primary coil around the outside of the secondary coil. Therefore, a simple arrangement automates the winding step.

BEST MODE FOR CARRYING OUT THE INVENTION

The best mode for carrying out the present invention will be described in more detail with reference to the accompanying drawings.

First Embodiment

The description of the first embodiment of the present invention will be described.

First, the transformer will be briefly described with reference FIG. 5 which is exploded perspective view of an ignitor-integral type bulb socket 20, even through the portions other than the transformer are the same as the above prior art and the patent application filed by the same applicant of this application.

Figure 1:
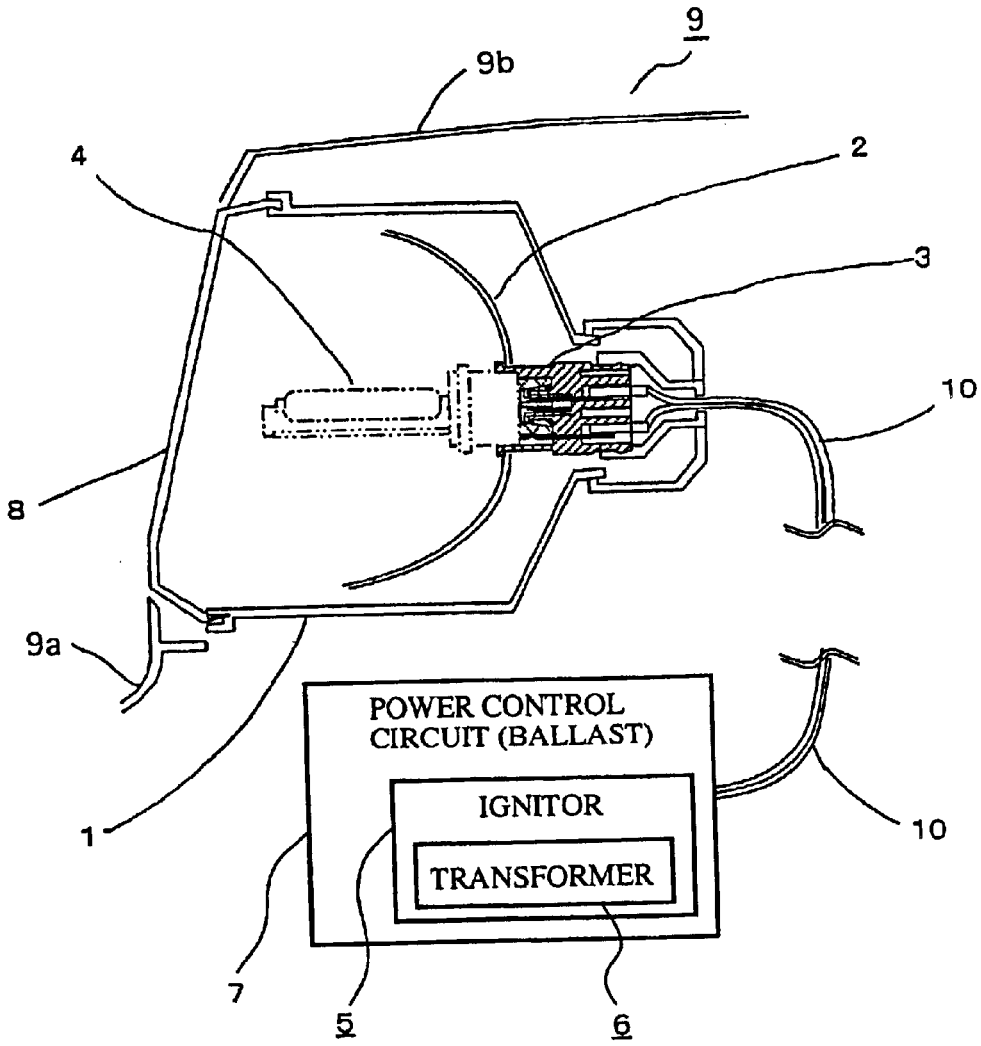
FIG. 1 shows a sectional view for explaining the state in which the conventional HID lighting device is mounted on a vehicle.
Figure 2:
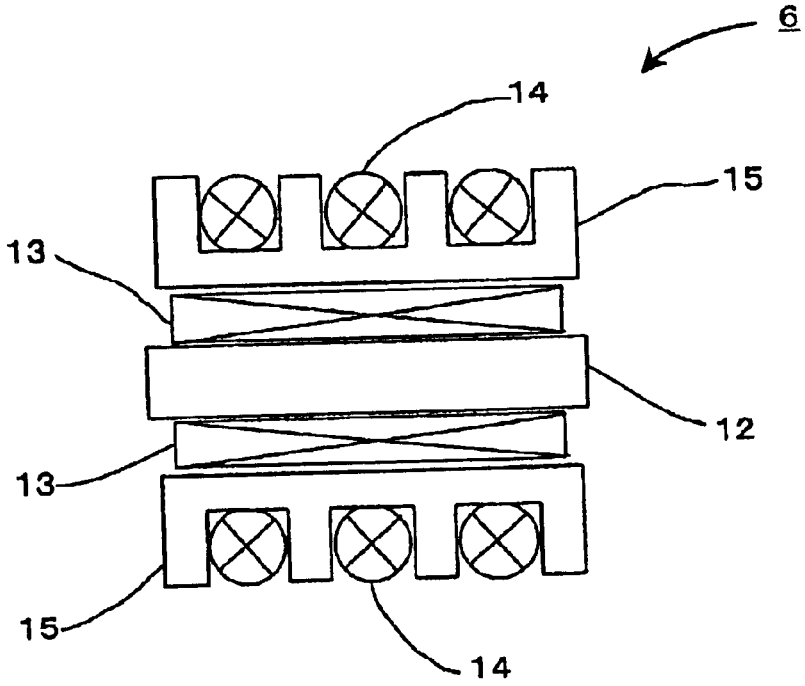
FIG. 2 shows a schematic diagram of a transformer to be used in the conventional HID lighting device.
Figure 3:
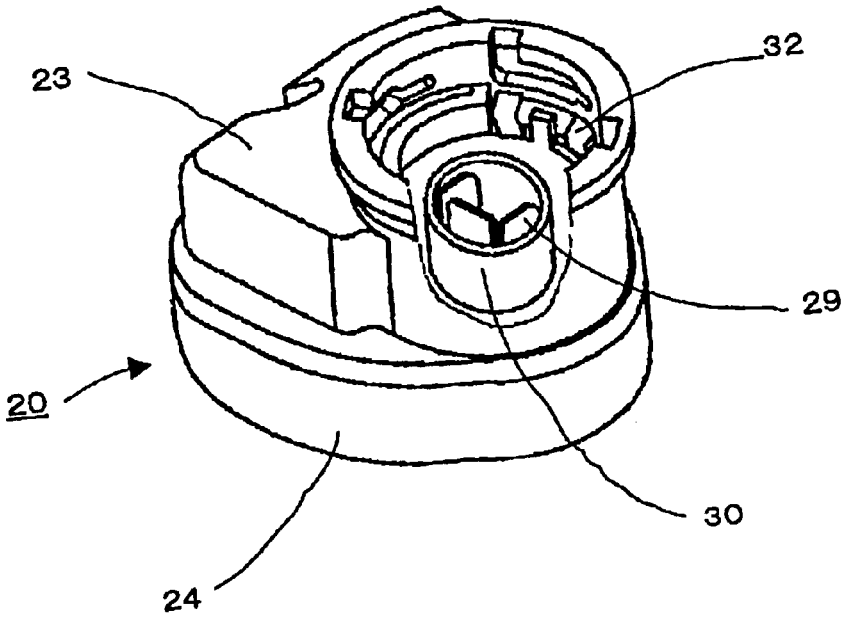
FIG. 3 shows a perspective view of an ignitor-integral type bulb socket as a comparative example.
Figure 4:
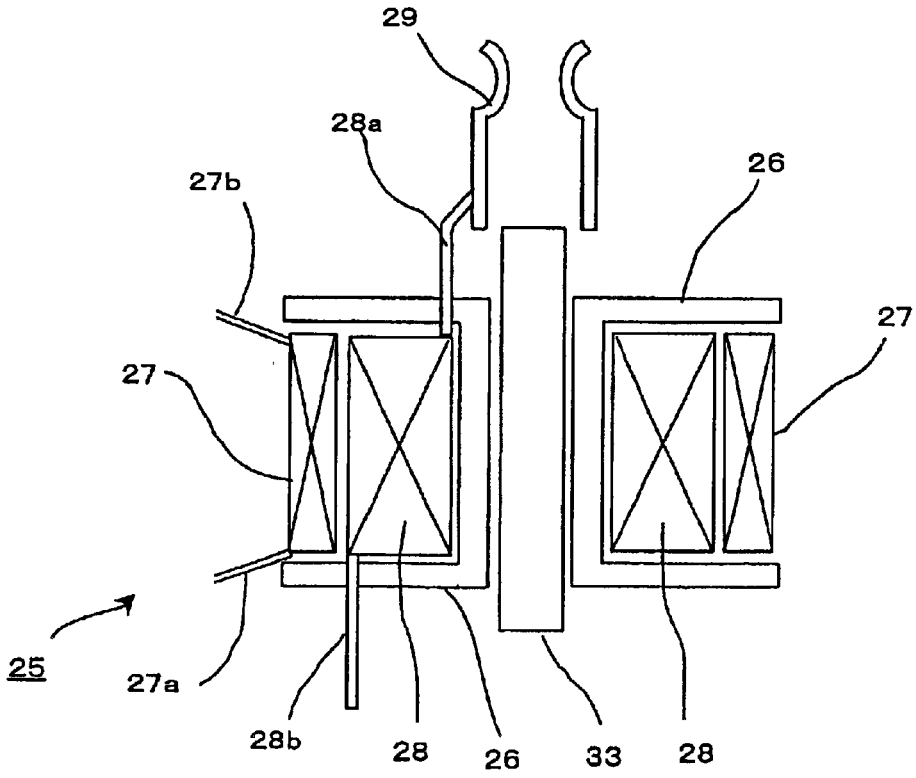
FIG. 4 shows a modeled schematic diagram of a transformer of the ignitor-integral type bulb socket as a comparative example.
Figure 5:
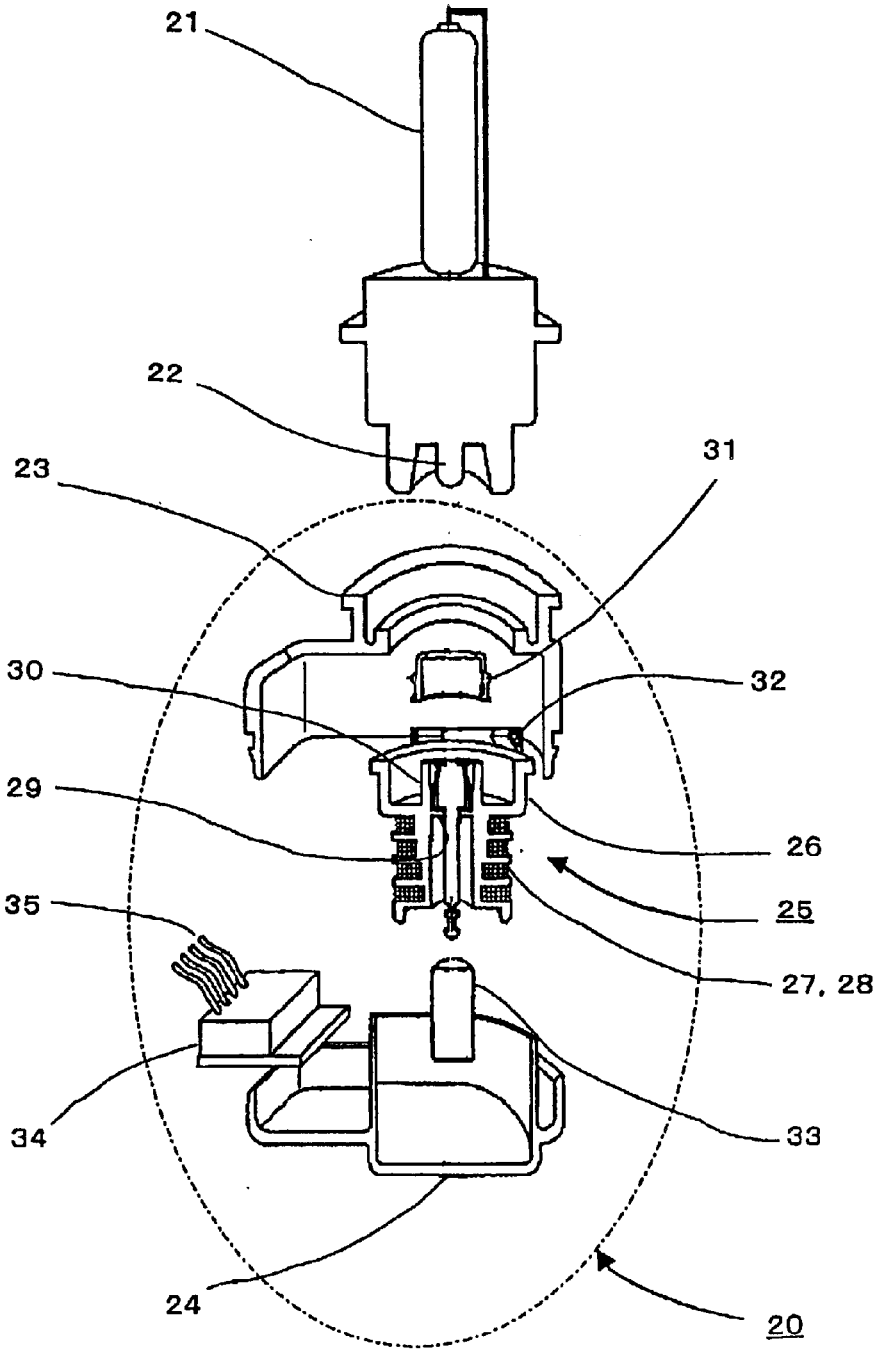
FIG. 5 shows a sectional perspective view for explaining the method of assembling the ignitor-integral type bulb socket according to a first embodiment of the present invention.

Referring to FIG. 5, reference numeral 21 denotes an HID bulb (discharge bulb), 22 a bulb plug for the discharge bulb 21, 23 an upper case forming an ignitor-integral type bulb socket 20, 24 a lower case, 25 a transformer, 26 a bobbin, 27, 28 a primary coil (a primary winding) and a secondary coil (a secondary winding), respectively, 30 a guide which is integrally formed with the bobbin 26, 31 an electrically insulating seal member of, e.g., silicone rubber which is covered over the guide 30 so as to cover the outside of the guide 30, 32 a low-voltage terminal, 33 a core, 34 an electronic circuit, and 35 a low-voltage harness connected to a power control circuit (ballast, not shown).

The circuit configuration for lighting control of the HID lighting device will be described With reference to FIG. 6.

Figure 6:
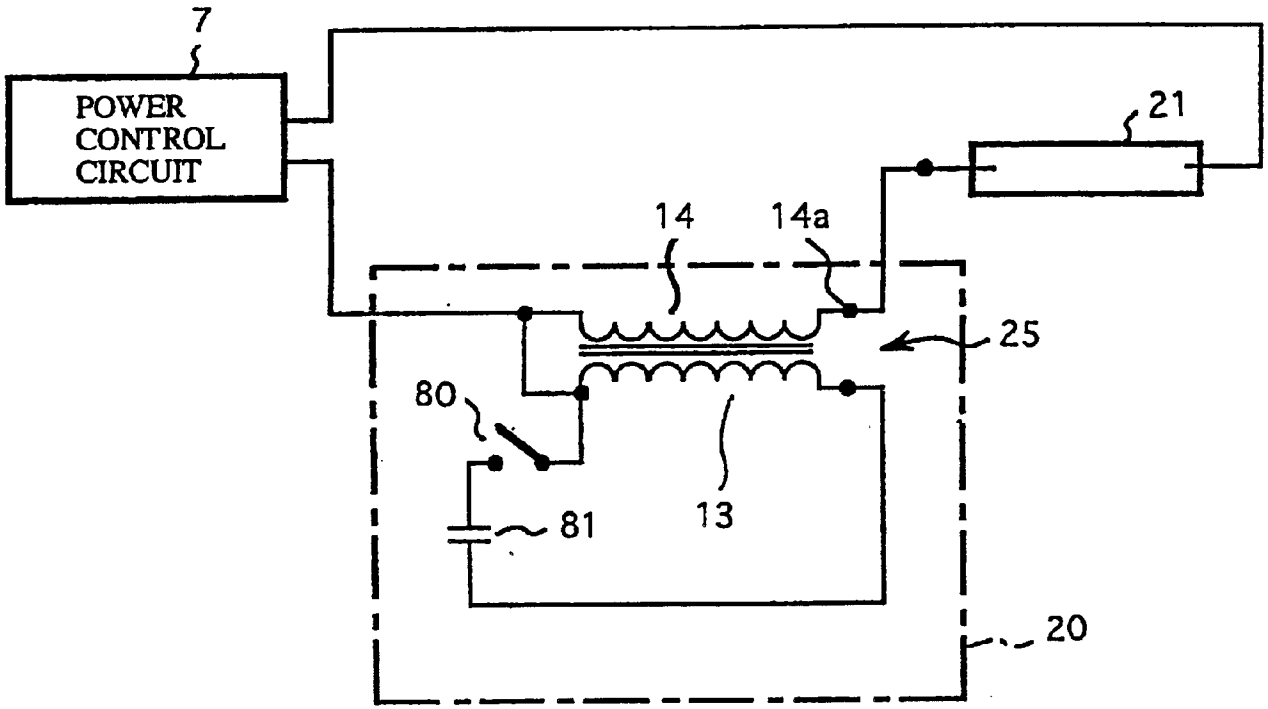
FIG. 6 is a schematic diagram for explaining the configuration of the lighting control of the HID igniting device according to a first embodiment.

Referring to FIG. 6, reference numeral 80 denotes a switch, 81 a capacitor. The ignitor 20 is formed by the switch 80, the capacitor 81, and the transformer 25. The transformer 25 is provided with a primary coil 13 and a secondary coil 14. An output of an output terminal 14*a* at an output side (an output-side terminal 14*a*) of the secondary coil is applied to the terminal on the high voltage side (high-voltage-side terminal) of the HID bulb 21.

Once the HID bulb 21 has been lighted by the ignitor 20, the voltage supply for lighting-on and the lighting control (alternating current supply) are made by a power control circuit 7.

Figure 7:
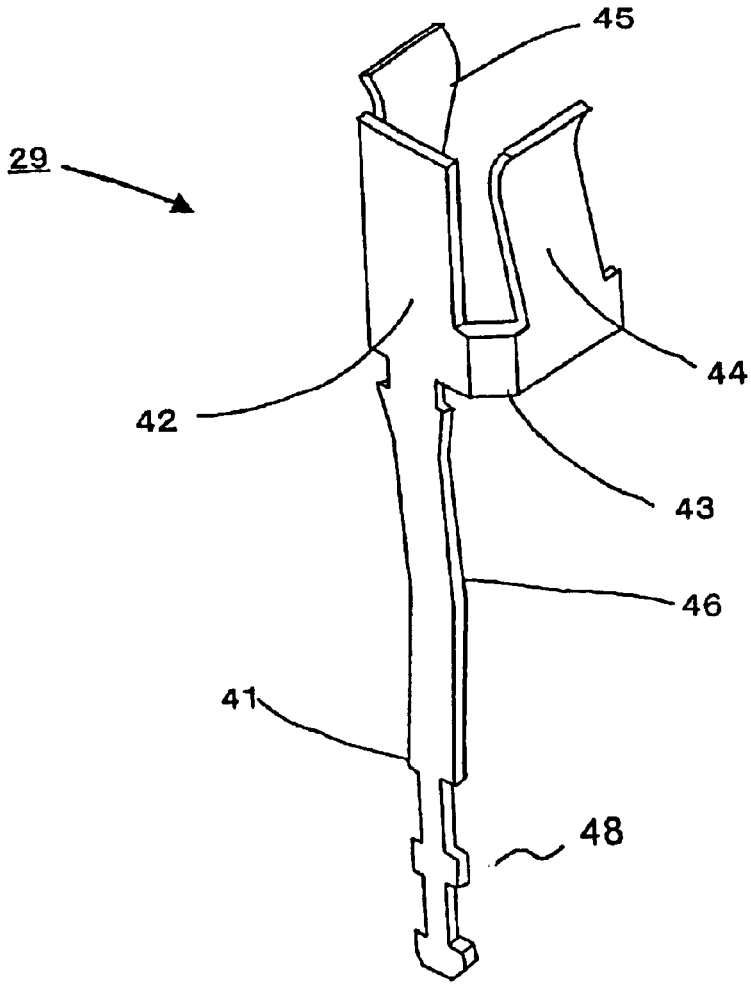
FIG. 7 shows a perspective view of a high-voltage terminal according to a first embodiment.
Figure 8:
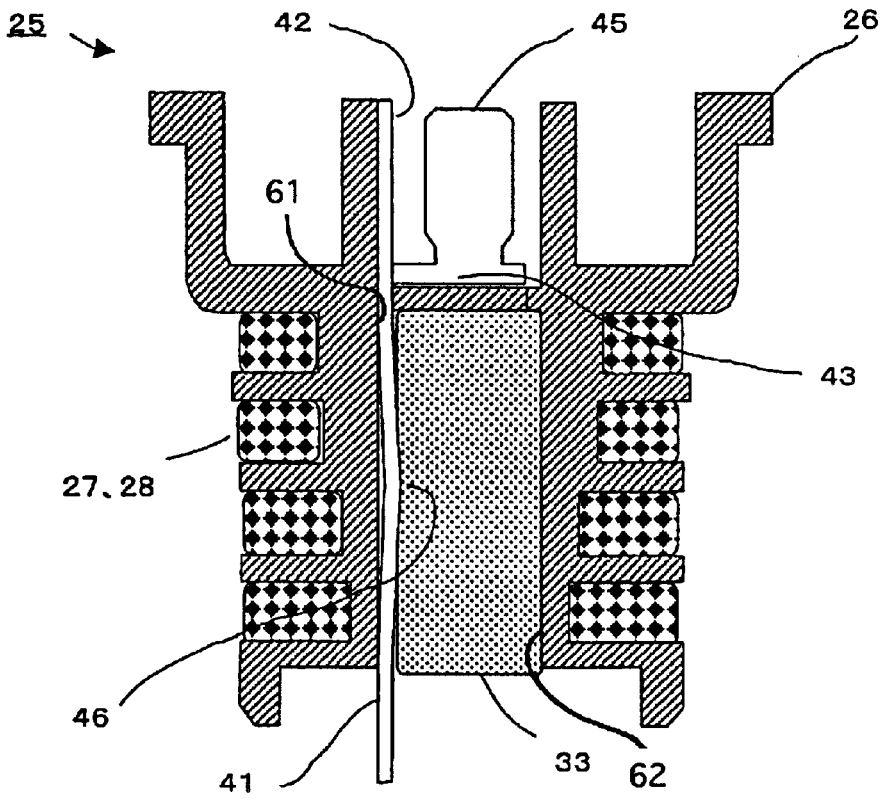
FIG. 8 shows a sectional view of a transformer according to a first embodiment.

FIG. 7 is a perspective view of the high-voltage terminal 29 used in the ignitor-integral type bulb socket according to the first embodiment. FIG. 8 is an axial sectional view of the transformer 25 in a state in which the high-voltage terminal 29 has been inserted into the bobbin 26.

Referring to FIGS. 7 and 8, reference numeral 29 denotes a high-voltage terminal brought into contact with, and is connected to, the terminal of the HID bulb (HID lamp). Reference numeral 41 denotes a leg of the high-voltage terminal 29. This leg 41 is inserted into the bobbin 26 of the transformer 25 along the core 33, and a coil wire is bound up (wound) around a coil binding 48 at a front end thereof and is thus connected thereto. Reference numeral 42 denotes a head of the high-voltage terminal 29 and which comes into contact with, and is connected to, the terminal of the HID bulb (HID lamp) 9. Reference numeral 43 denotes an arm which extends from the head 42 to the right and left, respectively. Reference numerals 44 and 45 denote contact claws which extend from the right and left arms 43 upward. Since these contact claws 44 and 45 are formed such that they face each other while sandwitching the bulb plug 22 therebetween when the HID bulb 9 is mounted in position, they securely come into contact with, and are connected to, the bulb plug 22.

The high-voltage terminal 29 thus formed by the above parts is provided with a curved part 46 in the leg 41 such that the leg 41 can be bent partially or entirely. The high-voltage terminal 29 having the leg 41 is inserted into a guide hole 70 which is provided at the central portion of the bobbin 26. The core 33 is thereafter assembled by inserting the leg 41 into the core-inserting hole 62 which is formed at the central portion of the bobbin 26. At this time, the curved part 46 provided in the leg 41 is urged by the core 33 toward the wall surface, and the core 33 is kept urged by the urging force generated by the elasticity of the curved part 46 toward an wall surface of the core-inserting hole. Therefore, by inserting the core 33 into the bobbin 26, the core 33 is fixed inside the bobbin 26.

The high-voltage terminal 29 may be formed by the press working of a punched metallic plate. At that time, the curved part 46 is formed by bending the leg 41 by a required amount.

Having taken the such an arrangement, when the core 33 is assembled by inserting it into the bobbin 26, the elastic urging force generated by the curved part 46 provided in the leg 41 acts to urge the core 33 toward the wall surface of the core-inserting hole. For example, even at the time the parts are transferred, the core 33 hardly gets out of position unless an external force beyond a predetermined level is applied to.

Accordingly, without adding a part which prevents the core 33 from being pulled out of position, the core 33 can be temporarily fixed to the bobbin 26. The core 33 thus will not be pulled out of position at the time the HID bulb, or the like is assembled.

Similarly, the high-voltage terminal 29 can also be temporarily fixed to the bobbin 26, and the core 33 will not be pulled out of position at the time the HID bulb is assembled.

Second Embodiment

Figure 9:
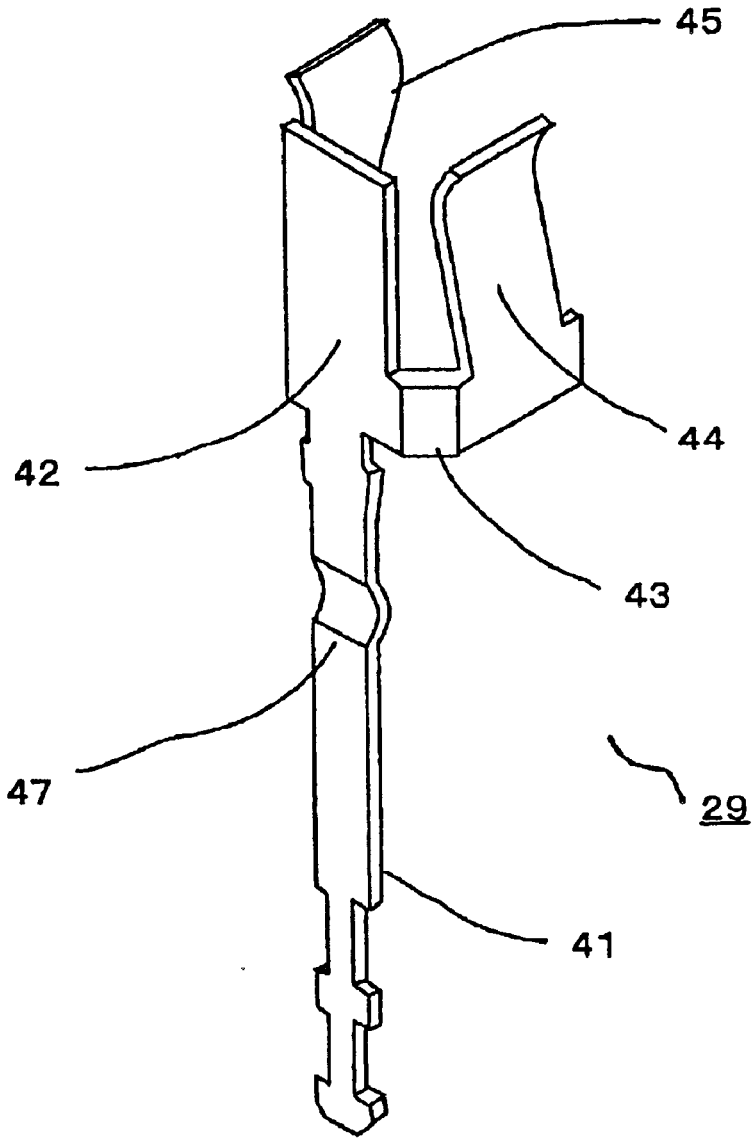
FIG. 9 shows a perspective view of a high-voltage terminal according to a first embodiment.
Figure 10:
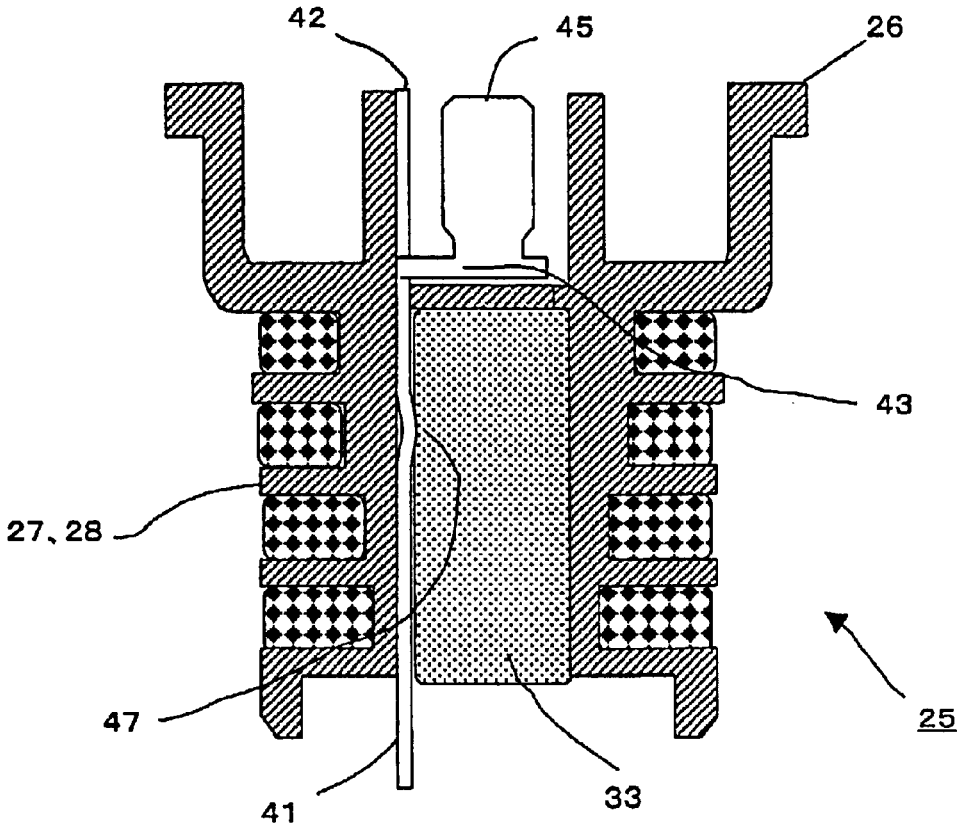
FIG. 10 shows a sectional view of a transformer according to a second embodiment of the present invention.

FIG. 9 is a perspective view of the high-voltage terminal 29 used in an ignitor-integral type bulb socket according to the second embodiment of the present invention. FIG. 10 is an axial sectional view of the transformer 25 in a state in which the high-voltage terminal 29 has been inserted into the bobbin 26.

In FIG. 9, the same reference numerals as those in the first embodiment are used and their descriptions are omitted for brevity's sake.

In FIGS. 9 and 10, the leg 41 is provided with a bump 47 instead of the curved part 46 in the first embodiment. This bump 47 provides a circular (or triangular) projection in the leg 41 and it may be formed by press working.

By urging the bump 47 toward the wall surface by means of the core 33, the core 33 is kept urged toward one-side wall surface of the core-inserting hole by the urging force generated by the elasticity of the bump 47. Therefore, by inserting the core 33 into the bobbin 26, the core 33 is fixed to the inside of the bobbin 26.

Having taken such an arrangement, when the core 33 is assembled by inserting it into the bobbin 26, the elastic urging force of the bump 47 provided in the leg 41 acts to urge the core 33 toward an wall surface of the core-inserting hole. For example, even at the time the parts are transferred, the core 33 is hardly get out of position unless an external force excess a predetermined level is applied to.

Therefore, without adding a part, e.g., for preventing the core 33 from being pulled out of position, the core 33 can be temporarily fixed to the bobbin 26. The core 33 thus will not be pulled out of position at the time the HID bulb, or the like is assembled.

Similarly, the high-voltage terminal 29 can also be temporarily fixed to the bobbin 26, and the core 33 will not be pulled out of position at the time the HID lamp is assembled.

Third Embodiment

Figure 11:
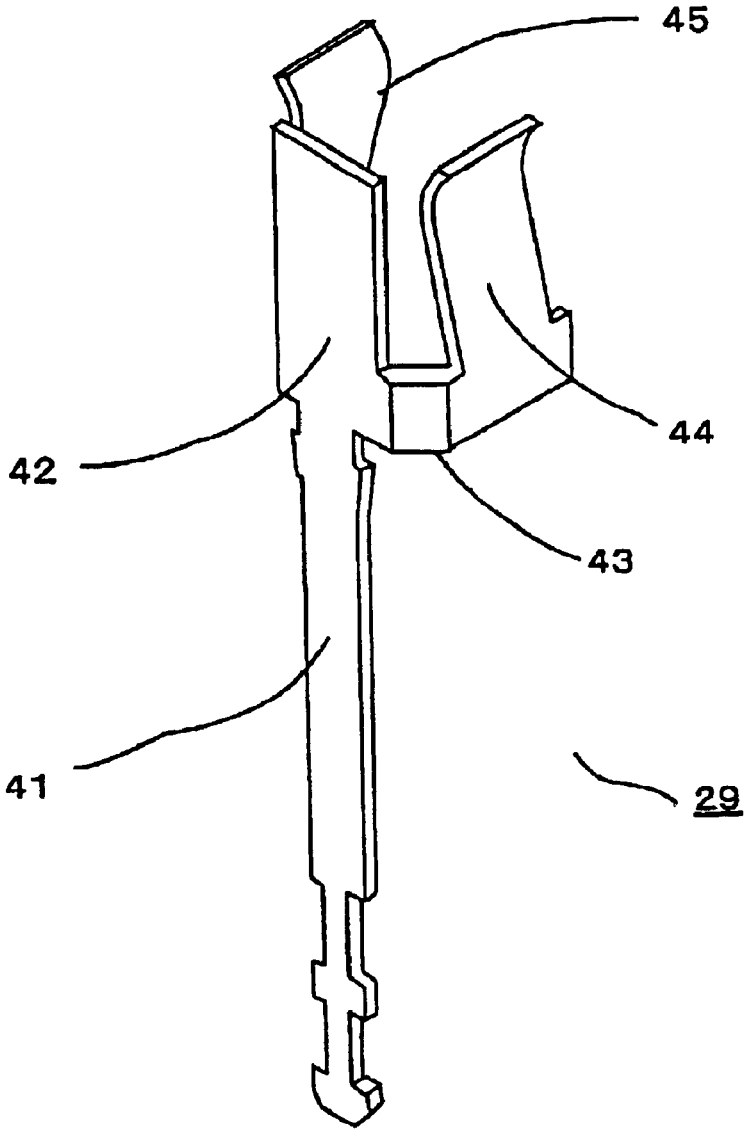
FIG. 11 shows a perspective view of a high-voltage terminal according to a second embodiment.
Figure 12:
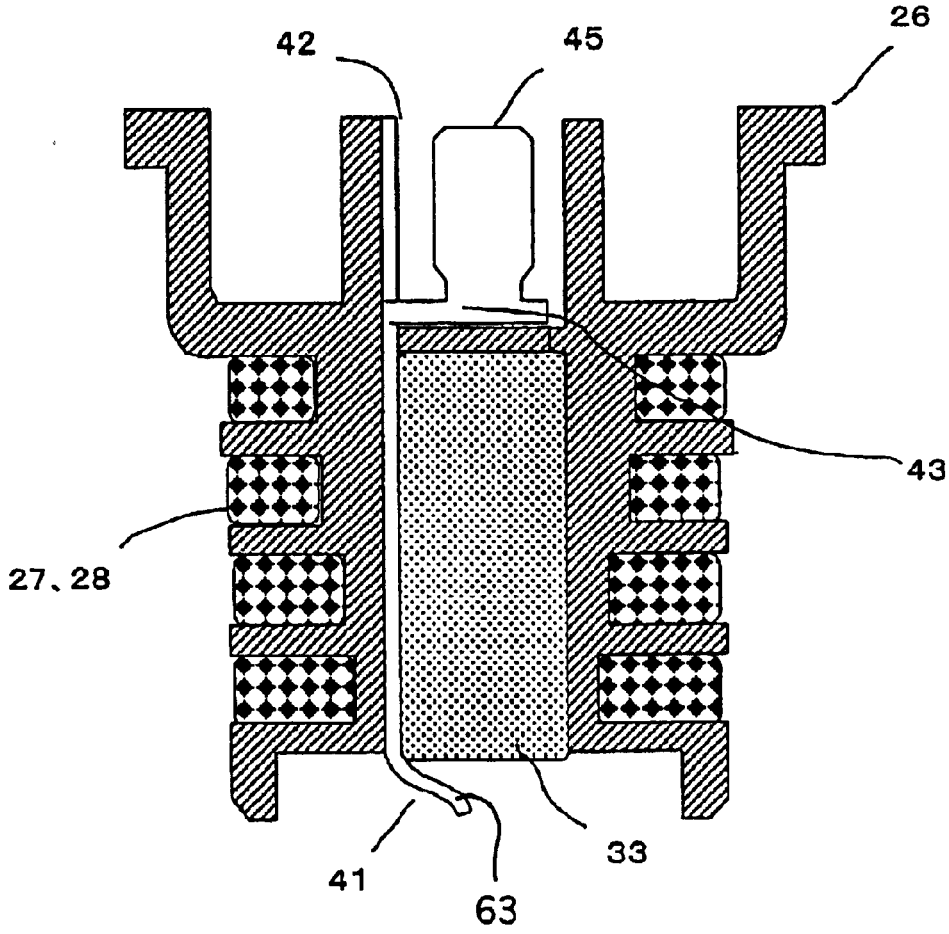
FIG. 12 shows a sectional view of a transformer according to a third embodiment of the present invention.

FIG. 11 is a perspective view of the high-voltage terminal 29 used in an ignitor-integral type bulb socket according to the third embodiment of the present invention. FIG. 12 is an axial sectional view of the transformer 25 in a state in which the high-voltage terminal 29 has been inserted into the bobbin 26.

In FIGS. 11 and 12, the same reference numerals as those in the first embodiment are used and their descriptions are omitted for brevity's sake.

In FIGS. 11 and 12, the leg 41 is provided with a bending part 63 to be bent after insertion, instead of the curved part 46 in the first embodiment.

This bending part 63 is formed by bending the front end of the leg 41 toward the core 33 after the high-voltage terminal 29 has inserted into the guide hole 70 provided in the central portion of the bobbin 26 and after the core 33 has assembled by inserting it into the core-inserting hole formed in the central portion of the bobbin 26. This bending part 63 supports the open-end surface of the core 33 to temporarily fix the core 33.

The bending part 63 also functions to prevent the high-voltage terminal 29 from being pulled out of position.

Having taken such an arrangement, after the high-voltage terminal 29 and the core 33 have assembled by inserting it into the bobbin 26, the front end of the high-voltage terminal leg 41 protruded beyond the end surface of the open end of the core 33 is bent to form the bending part 63 so that the core 33 is supported from the open side. For example, even at the time the parts are transferred, the core 33 is hardly get out of position unless an external force excess a predetermined level is applied to.

In this manner, without adding a part, e.g., for preventing the core 33 from being pulled out of position, the core 33 can be temporarily fixed to the bobbin 26. The core 33 thus will not be pulled out of position at the time the HID bulb, or the like is assembled.

Similarly, the high-voltage terminal 29 can also be fixed to the bobbin 26, and the core 33 will therefore not be pulled out of position at the time of assembly, or the like.

Fourth Embodiment

Figure 13:
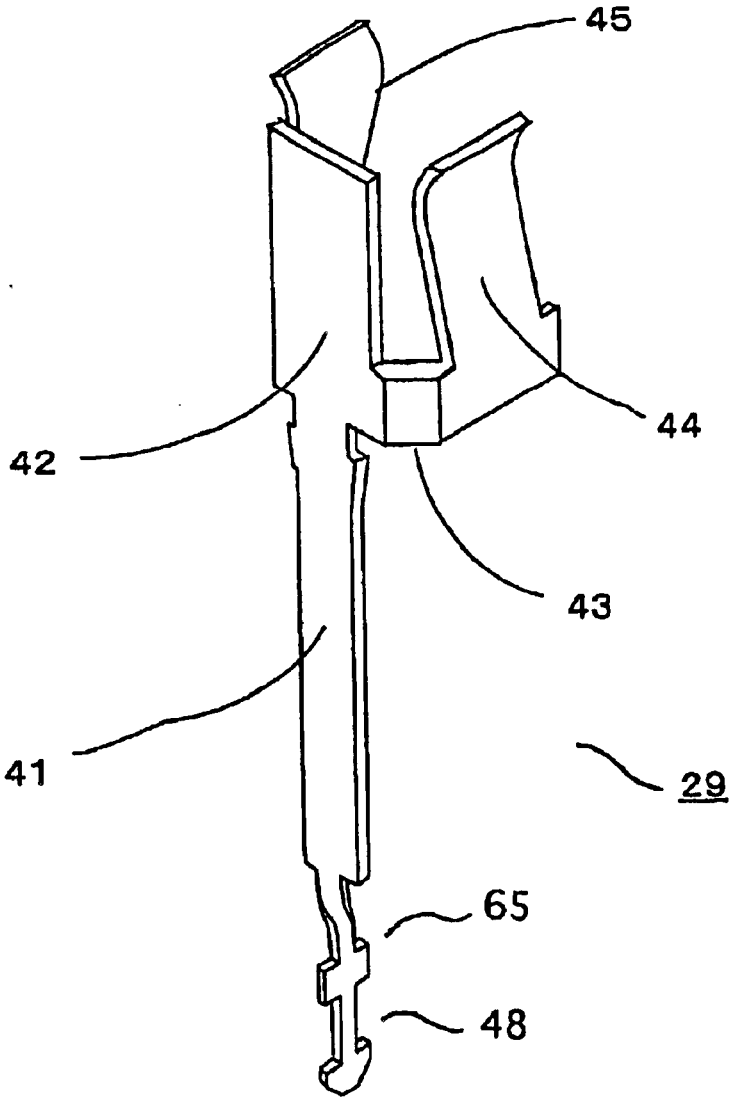
FIG. 13 shows a perspective view of a high-voltage terminal according to a third embodiment.
Figure 14:
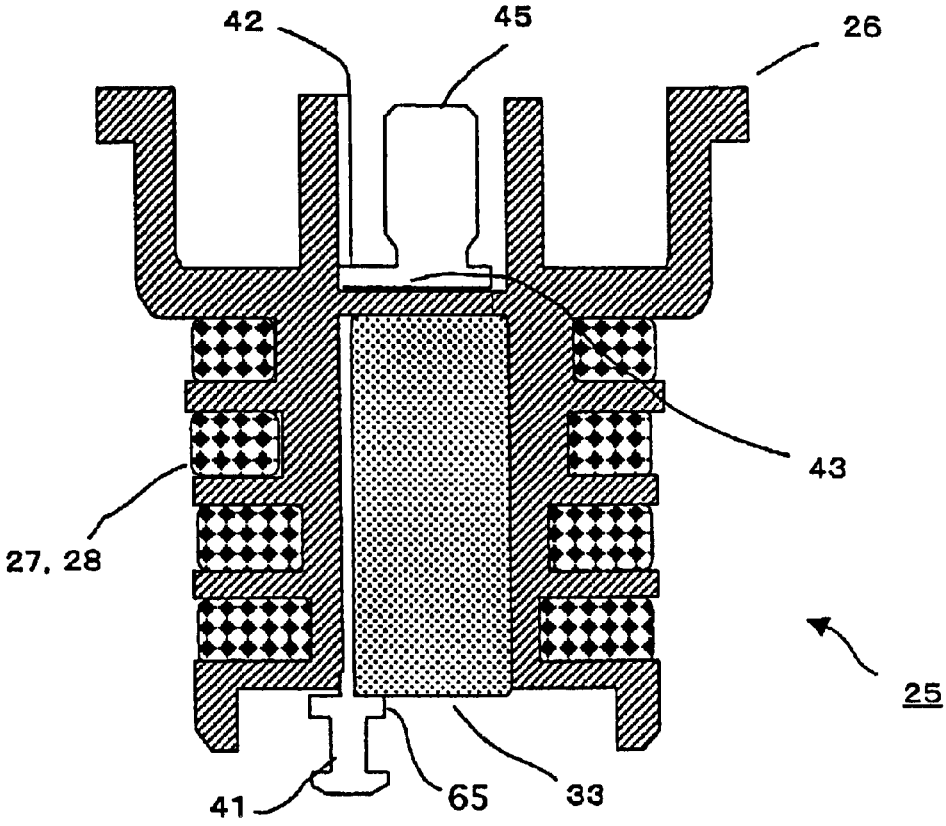
FIG. 14 shows a sectional view of a transformer according to a fourth embodiment of the present invention.

FIG. 13 is a perspective view of the high-voltage terminal 29 used in an ignitor-integral type bulb socket according to the fourth embodiment of the present invention. FIG. 14 is an axial sectional view of the transformer 25 in a state in which the high-voltage terminal 29 has been inserted into the bobbin 26.

In FIGS. 13 and 14, the same reference numerals as those in the first embodiment are used and their descriptions are omitted for brevity's sake.

In FIGS. 13 and 14, the high-voltage terminal 29 is inserted into the guide hole 70 formed in the central portion of the bobbin 26. Then, after the core 33 has assembled by inserting it into the core inserting hole in the central portion of the bobbin 26, the front end of the leg 41 is twisted by about 90E, thereby forming a twisted part 64. In this manner, the open-end surface of the core 33 is supported by a projected part 65 of the coil-binding 48.

The twisted part 64 also functions to prevent the high-voltage terminal 29 from being pulled out of position.

The high-voltage terminal 29 as illustrated in FIG. 13 shows a state in which the twisted part 64 has already been formed.

Having taken such an arrangement, after the high-voltage terminal 29 and the core 33 have assembled by inserting it into the bobbin 26, the portion in the front end of the high-voltage terminal leg 41 protruded beyond the open-end surface of the core 33 is twisted to form the twisted part 63 so that the core 33 is supported from the open-end side. For example, even at the time the parts are transferred, the core 33 hardly gets out of position unless an external force excess a predetermined level is applied to.

Therefore, without adding a part, e.g., for preventing the core 33 from being pulled out of position, the core 33 can be temporarily fixed to the bobbin 26. The core 33 thus will not be pulled out of position at the time, e.g., of assembling the HID bulb.

Similarly, the high-voltage terminal 29 can also be temporarily fixed to the bobbin 26, and the core 33 will not be pulled out of position at the time the HID lamp is assembled.

Fifth Embodiment

Figure 15:
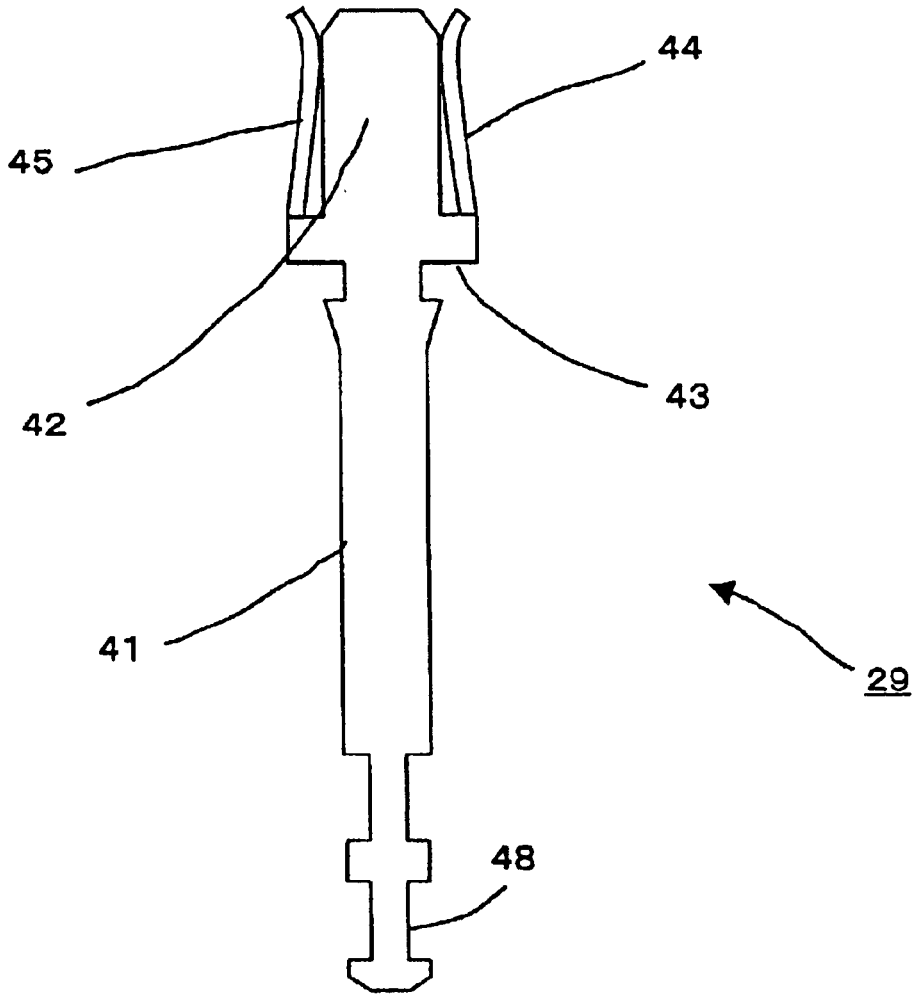
FIG. 15 shows a perspective view of a high-voltage terminal according to a fifth embodiment of the present invention.
Figure 16:
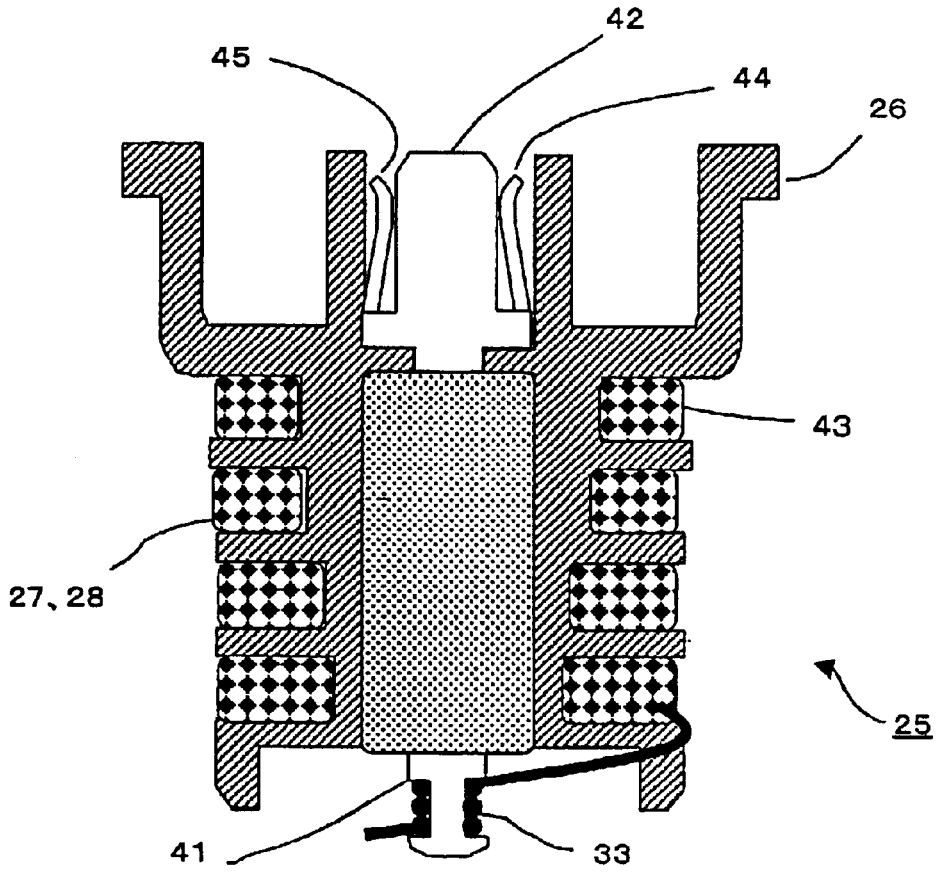
FIG. 16 shows a sectional view of a transformer according to a fifth embodiment.

FIG. 15 is a perspective view of the high-voltage terminal 29 used in an ignitor-integral type bulb socket according to the fifth embodiment of the present invention. FIG. 16 is an axial sectional view of the transformer 25 in a state in which the high-voltage terminal 29 has been inserted into the bobbin 26.

In FIGS. 15 and 16, the same reference numerals as those in the first embodiment are used and their descriptions are omitted for brevity's sake.

This fifth embodiment describes coil binding 48 of a narrow-width shape provided at a front end of the leg 41 of the high-voltage terminal 29.

In FIGS. 15 and 16, the high-voltage terminal 29 is inserted into the guide hole 70 which is formed in the central portion of the bobbin 26 and thereafter the core 33 is assembled by inserting it into the core-inserting hole in the central portion of the bobbin 26. At that time, some measure is taken to the core 33 to prevent it from getting out of position by any one of the methods shown in the above first through fourth embodiments. Then, in the next step, the secondary coil 28 is wound around the bobbin 26. In order to wind the initial winding part of the secondary coil 28, there is provided a coil binding 48 at the front end of the leg of the high-voltage terminal 29.

Having taken such an arrangement, when the secondary coil 28 is wound around the bobbin 26, the initial winding part of the secondary coil 28 is wound around the coil binding 48 of the high-voltage terminal 29 and is then fixed. Thereafter, the secondary coil 28 can be wound around a peripheral groove of the bobbin 23 for a predetermined number of times. Therefore, without requiring additional parts for winding the initial winding part such as a special projection for winding the coil therearound, the coil can be bound up directly on the high-voltage terminal 29. This remarkably improves the workability and enhances the mass-productivity with an automatic assembling apparatus.

Sixth Embodiment

Figure 17:
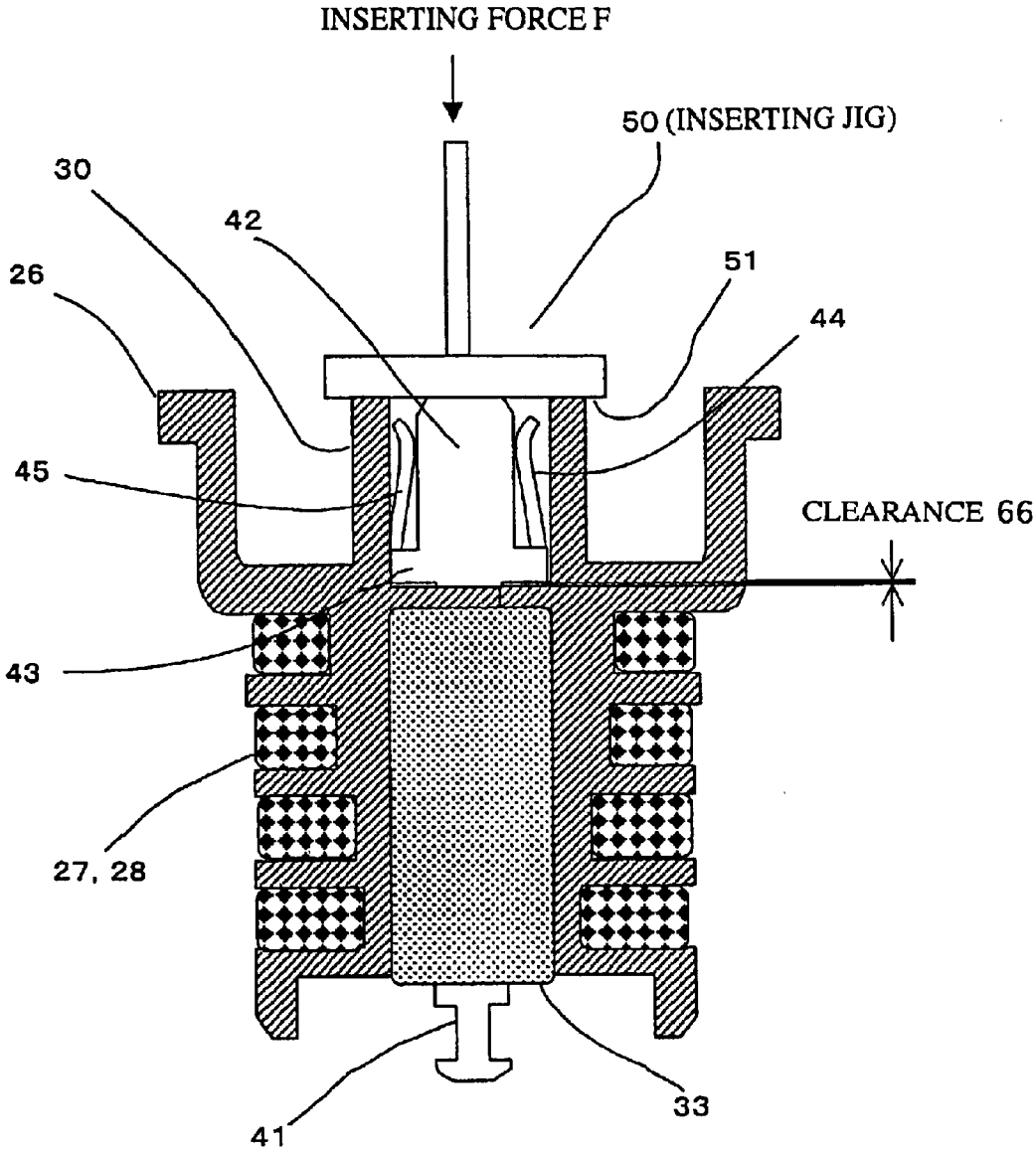
FIG. 17 shows a sectional view of a transformer in a state in which a high-voltage terminal according to a sixth embodiment of the present invention has been inserted.

FIG. 17 is an axial sectional view showing the assembling state in inserting the high-voltage terminal 29 into the bobbin 16, which is used in an ignitor-integral type bulb socket according to the sixth embodiment of the present invention.

In FIG. 17, the same reference numerals as those in the first embodiment are used and their descriptions are omitted for brevity's sake.

This sixth embodiment describes the method of inserting the high-voltage terminal 29 into the bobbin 26.

In FIG. 17, the tip of the contact claws 44, 45 of the high-voltage terminal 29 is respectively set slightly lower (several millimeters) than that of the head 42.

In FIG. 17, reference numeral 50 denotes an inserting jig for inserting the high-voltage terminal 29 into the bobbin 26. The urging surface 51 of the inserting jig 50 is flat in shape and has an area large enough to cover the guide 30 which is integrally formed with the bobbin 26. Therefore, when the high-voltage terminal 29 is inserted into the bobbin 26, the high-voltage terminal 29 begins to be inserted by urging the head 42 of the high-voltage terminal 29 with the urging surface 51 of the inserting jig 50. At a point of time the urging surface 51 of the inserting jig 50 comes into contact with the open-end surface of the guide 30, the inserting jig 50 stops, and finishes the insertion of the high-voltage terminal 29 into the bobbin 26.

Having taken such an arrangement, at the time the high-voltage terminal 29 is inserted and assembled, the urging surface 51 of the inserting jig 50 is restricted by the guide 30 of the bobbin 26. It is thus possible to assemble by inserting the high-voltage terminal 29 regularly to a predetermined depth, thereby improving the stability in the insertion and assembly.

Further, it is possible to form a clearance 66 as illustrated in FIG. 17 between the bobbin 26 and the arms 43 of the high-voltage terminal 29, and to dispense with the positioning on the surface of the bobbin 26 (because the bobbin 26 is formed by-resin molding, its surface has a lower finishing accuracy). This improves the stability in insertion and assembly of the high-voltage terminal 29.

Furthermore, the leg 41 of the high-voltage terminal 29 projects beyond the lower portion of the bobbin 26 at a constant amount. Therefore, when the leg 41 is temporarily fixed to the bobbin 26 as described in the above first and the fourth embodiments, the work can be made stably. Still furthermore, the secondary coil can be wound around the coil binding 48 as described in the fifth embodiment in a stable position. Particularly, this holds true when an automatic winding machine is utilized.

Seventh Embodiment

Figure 18:
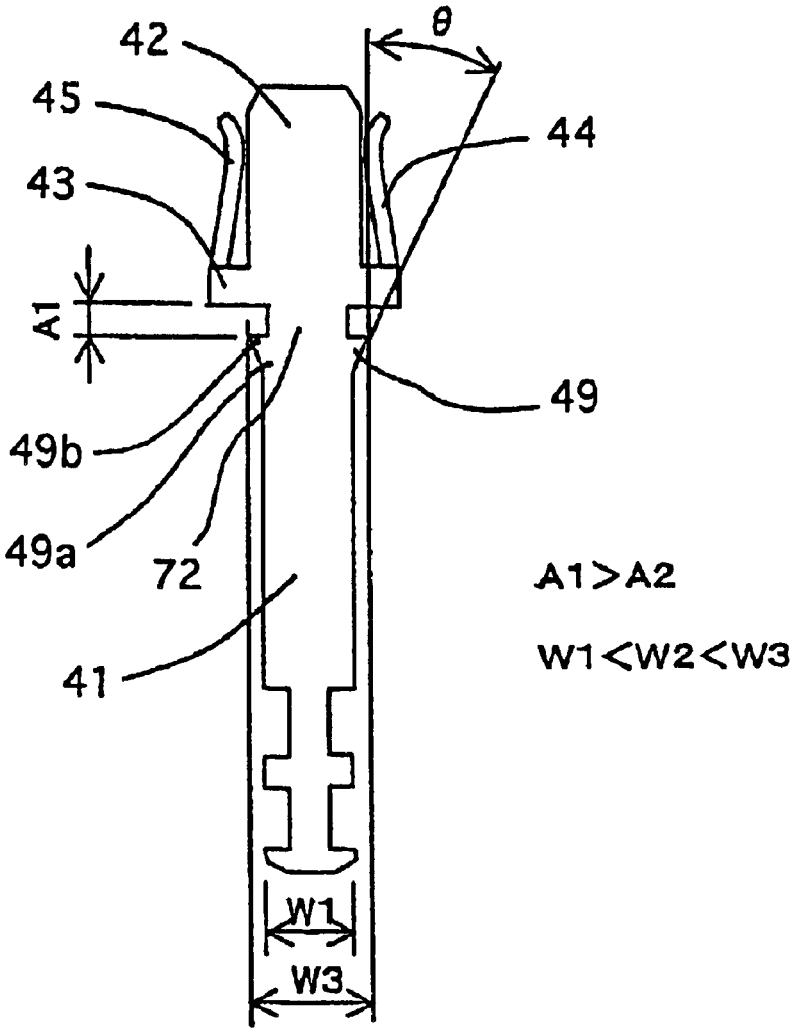
FIG. 18 shows a perspective view of a high-voltage terminal according to a seventh embodiment of the present invention.
Figure 19:
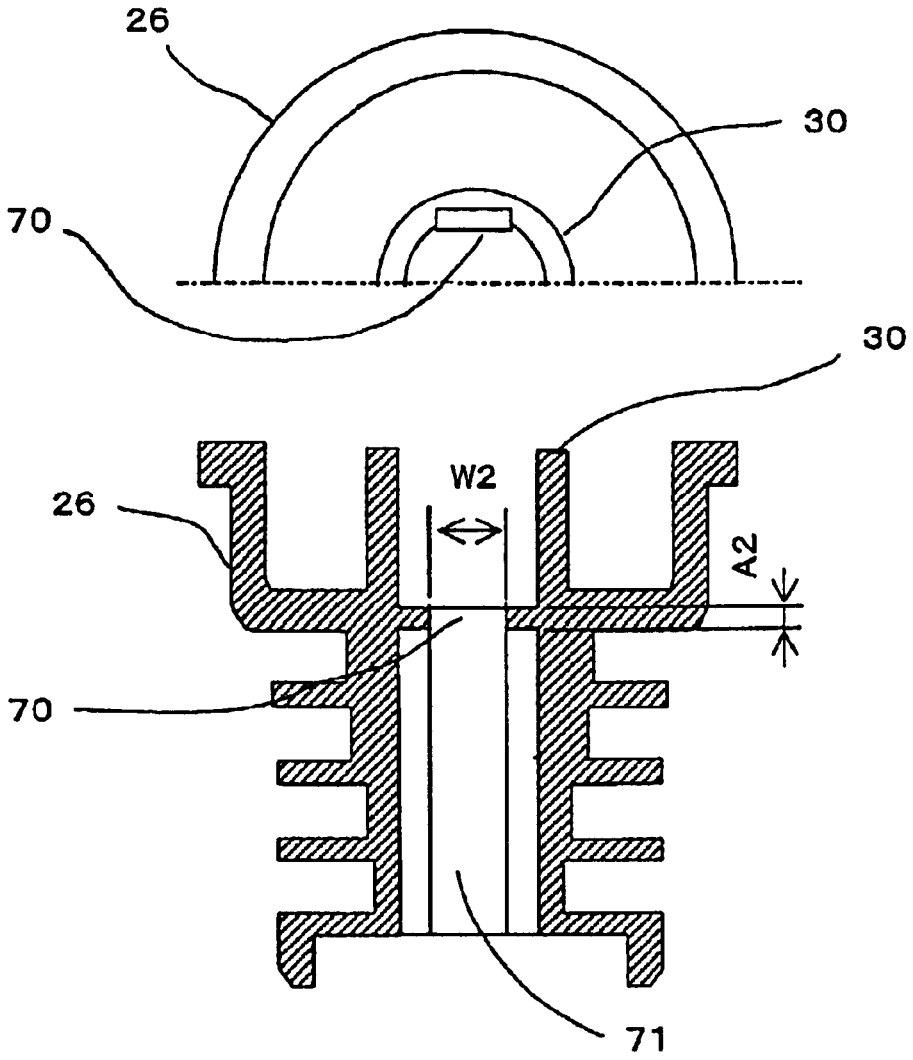
FIG. 19 shows a sectional view of a bobbin according to a seventh embodiment.

FIG. 18 is a rear view for explaining the shape of the high-voltage terminal 29 to be used in an ignitor-integral type bulb socket according to the seventh embodiment of the present invention. FIG. 19 is an axial sectional view of the bobbin 26.

In FIGS. 18 and 19, the same reference numerals as those in the first embodiment are used and their descriptions are omitted for brevity's sake.

This seventh embodiment describes an enlarged part 49 provided in the high-voltage terminal 29.

In FIGS. 18 and 19, reference numeral 49 denotes the enlarged part having a shape in which the leg 41 of the high-voltage terminal 29 close to the head 42 is enlarged in the widthwise direction. This enlarged part 49 has a tapered surface 49*a* whose width becomes gradually smaller as goes to the front end of the leg. The widest portion of the enlarged part 49 has a corner 49*b* of an acute angle. Between the acute-angle corner 49*b* of the enlarged part 49 and the right and left arms 43, there is provided a neck 72 of substantially the same width as the leg 41. The bobbin 26 has formed inside the guide 30 a guide hole 70 for inserting therethrough the leg 41 of the high-voltage terminal 29. On an inner wall surface of the core-inserting hole 62, there is provided a guide groove 71 which is carved on the wall surface along the entire axial length starting from the portion where the guide hole 70 is positioned. The width of the guide groove 71 is set to be slightly smaller than the maximum width of the enlarged part 49 provided in the leg 41 of the high-voltage terminal 29. Here, let the widthwise dimension of the leg 41 be W1, the maximum widthwise dimension of the enlarged part 49 be W3, and the groove width of the guide groove 71 be W2. Further, let the dimension from the bottom surface of the arm 43 to the upper surface of the enlarged part 49 be A1, and the dimension in the thickness direction of the guide hole 70 in the bobbin 26 be A2. Then, the dimensional relationship among them is expressed to be $W1<W2<W3$ and $A1>A2$.

Having taken such an arrangement, when the high-voltage terminal 29 is inserted into the guide hole 70 and the guide groove 71 in the bobbin 26, the enlarged part 49 having the tapered surface 49*a* is easily movable toward the tapered surface 49*a* (i.e., in the inserting direction), so that the high-voltage terminal 29 can be smoothly inserted. However, toward the corner 49*b* (i.e., in the direction opposite to the inserting direction), the corner 49*b* gets stuck or gets bitten widthwise at the wall surface of the guide hole 70 or the guide groove 71. The high-voltage terminal 29 thus hardly gets out of position (i.e., pulled out in a direction opposite to the inserting direction) from the bobbin 26.

Further, since the dimension A1 of the neck 72 of the high-voltage terminal 29 is made slightly larger than the thickness dimension A2 of the guide hole 70 in the bobbin 26, even if the widthwise dimension of the guide groove 71 is set to be slightly smaller than the widthwise dimension of the guide hole 70, the corner 49*b* of the enlarged part 49 is inserted to a position where the guide hole 70 has surely passed through and gets bitten. This securely prevents the high-voltage terminal 29 from getting out of position.

Eighth Embodiment

FIG. 5 is a sectional perspective view for explaining the method of assembling the ignitor-integral type bulb socket according to the eighth embodiment.

In FIG. 5, the same reference numerals as those in each of the above embodiments are used and their descriptions are omitted for brevity's sake.

An example of the method of assembling the ignitor-integral type bulb socket 20 will be described with reference to FIG. 5.

First, the transformer 25 is assembled. The high-voltage terminal 29 is assembled by inserting it into the bobbin 26 and thereafter the core 33 is inserted. The initial winding of the secondary coil 28 is wound around the coil binding 48 at the end of the leg of the high-voltage terminal 29. Thereafter, the secondary coil 28 is wound around each layer in the bobbin 26 and the terminal end thereof is bound up around the temporarily fixing part (not shown) of the bobbin 26, and the primary coil 13 is wound around the outside of the secondary coil 28. Thereafter, on the outside of the guide 30 formed integrally with the bobbin 26, the electrically insulating sealing member 31 is inserted and assembled, whereby the transformer 25 is finished.

Then, the transformer 25 is received inside a partition wall in the lower case 24. In this state, a molten resin is filled into the clearance formed between the transformer 25 and the partition wall in the lower case 24 and is then hardened, thereby integrating the transformer 25 and the lower case 24 together.

After the resin has hardened, the low-voltage terminal 32 and the electronic circuit 34 are mounted, and the upper case 23 is then covered thereon, whereby the assembling of the ignitor-integral type bulb socket 20 is finished.

Having adopted such an assembly method, there are the following advantages that the automatic assembly of the transformer assembly 25 becomes possible, and that a simple parts arrangement makes the assembly work very easy. Further, the above arrangement and assembly method enables a large reduction in size.

Therefore, the efficient automation in the assembly work remarkably improves the productivity, thereby providing small and light-weight ignitor-integral type bulb sockets at a smaller cost.

While, in each of the above embodiments, an example has been shown in which this invention was used in a headlight of a motor vehicle, without being limited thereto, this invention may also be used for other mobile bodies such as ships, trains, or the like. Further, it may also be used for lights, street lights, or the like for outdoor facilities, warehouses, factories, houses, or the like.

Each of the above embodiments have so far been described, and each has the following features.

As one of the features of each of the embodiments, the following is given.

Namely, in an ignitor-integral type bulb socket comprising a transformer made up of a bobbin which is formed of a resin and around which a primary coil and a secondary coil are wound, a core of high magnetic permeability inserted into the central hole of the bobbin, and a high-voltage-side terminal inserted substantially into the central portion of the bobbin and connected to the secondary coil for applying a high voltage to a high-voltage-side plug of the lamp; a low-voltage-side terminal inserted into the outside of the bobbin and connected to a low-voltage-side plug of the lamp; electronic parts for controlling the generation of the high voltage; and a lower case and an upper case for receiving therein the above members, means is provided for preventing the core inserted into the central hole of the bobbin from being pulled out at the time the transformer is assembled.

In addition, in an ignitor-integral type bulb socket comprising a bobbin which is formed of a resin and around which a primary coil and a secondary coil are wound; a core of high magnetic permeability inserted into the central hole of the bobbin; a high-voltage-side terminal inserted substantially into the central portion of the bobbin and connected to the secondary coil for applying a high voltage to a high-voltage-side plug of the lamp; a low-voltage-side terminal inserted into the outside of the bobbin and connected to a low-voltage-side plug of the lamp; electronic parts for controlling the generation of the high voltage; and a lower case and an upper case for receiving therein the above members, means is provided for preventing the core inserted into the central hole of the bobbin from getting out of position at the time the transformer is assembled, when the transformer which is a part of the ignitor to be formed integrally with the bulb socket is assembled, at the time the core has been inserted into the central hole of the bobbin, the core can be securely fixed to the predetermined position during the work proceeds to the next step.

Since this obviates the possibility that the core would be moved or dropped out of the predetermined position during the work proceeds to the next step or while working in the next step, there can be provided a transformer of good productivity at a low cost.

As another feature, the following is given.

Namely, the means for preventing the core from getting out of position is means having a structure in which the core is assembled by inserting it into the central hole of the bobbin is urged by the elastic force of the leg of the high-voltage-side terminal. Therefore, the bulb socket gives, as means for preventing the core from being separated, an urging force to urge the core in one direction by the elastic force of the leg of the high-voltage-side terminal, thereby preventing the core from getting out of position. In this arrangement, by employing the spring characteristic of the high-voltage-side terminal which has been inserted into the guide groove of the bobbin, an urging force is applied to urge the core which has been inserted into the central hole of the bobbin against the hole wall surface on a side opposite to the side in which the core and the high-voltage-side terminal come into contact with each other. Therefore, without increasing the number of parts, the core can be easily and stably retained, thereby preventing the core from getting out of position without raising cost.

As another feature, the following is given.

Namely, the-means for preventing the core from getting out of position is means having a structure in which the leg of the high-voltage-side terminal is provided with a bump which protrudes toward the core side so that the core is urged by the elastic force of the projected part. The bulb socket is formed into a shape in which the bump is provided in the leg of the high-voltage-side terminal so that the core inserted into the central hole of the bobbin is urged by the bump which protrudes partly toward the core side of the high-voltage-side terminal which has been inserted into the guide hole of the bobbin. Therefore, without increasing the number of parts, the core can be easily and stably retained, thereby preventing the core from getting out of position without raising cost.

As another feature, the following is given.

Namely, the means for preventing the core from getting out of position is means having a structure in which the leg of the high-voltage-side terminal is bent to urge the core by the elastic force of the bent portion. The bulb socket is formed into a shape in which the leg of the high-voltage-side terminal is bent toward one direction within an adequate range so that the core inserted into the central hole of the bobbin is urged toward a predetermined diametrical direction by the spring characteristic of the bent portion of the high-voltage-side terminal which has been inserted into the guide groove of the bobbin. Therefore, without increasing the number of parts, the core can be easily and stably retained, thereby preventing the core from getting out of position without raising cost.

As another feature, the following is given.

The means for preventing the core from getting out of position is means having a structure in which the free end surface on the pulled-out side of the core is supported by the end of the leg of the high-voltage-side terminal. The bulb socket is formed into a structure in which the free end surface on the pulled-out side of the core which has been inserted into the central hole of the yoke is retained by substantially the front end of the leg of the high-voltage-side terminal so that the axial movement of the core is restricted by supporting the pulled-out free end surface of the core by the substantially front end of the high-voltage-side terminal. Therefore, without increasing the number of parts, the core can be easily and stably retained, thereby preventing the core from getting out of position without raising cost.

As another feature, the following is given.

The means for preventing the core from getting out of position is means having a structure in which the end of the leg of the high-voltage-side terminal is bent toward the core side so that the pulled-out free end surface of the core is supported by the bent portion of the leg of the high-voltage-side terminal. The bulb socket is formed into a structure in which the front end of the leg of the high-voltage-side terminal is bent toward the core end surface after the core has been inserted and assembled so that the end of the core is restricted in position by the bent portion at the front end of the high-voltage-side terminal. Therefore, without increasing the number of parts, the core can be easily and stably supported, thereby preventing the core from getting out of position without raising cost.

As another feature, the following is listed.

The means for preventing the core from getting out of position is means having a structure in which the high-voltage terminal is provided at an end of the leg with a notched portion and the notched portion is then twisted so that the pulled-out free end of the core is supported by the shoulder of the notched portion of the twisted part. The bulb socket is formed into a structure in which the notched portion provided in the front end of the leg of the high-voltage terminal is twisted after the core has been inserted and assembled so that the pulled-out free end surface of the core is supported by the shoulder surface of the notched portion. Having taken such an arrangement in which the axial movement of the core is restricted by the shoulder surface of the notched portion at the front end of the high-voltage terminal, the core can be easily and stably supported without increasing the number of parts, thereby preventing the core from being dropped out of position without raising cost.

As another feature, the following is given.

Namely, in an ignitor-integral type bulb socket comprising a transformer made up of a bobbin which is formed of a resin and around which a primary coil and a secondary coil are wound, a core of high magnetic permeability inserted into the central hole of the bobbin, and a high-voltage-side terminal inserted substantially into the central portion of the bobbin and connected to the secondary coil for applying a high voltage to a high-voltage-side plug of the lamp; a low-voltage-side terminal inserted into the outside of the bobbin and connected to a low-voltage-side plug of the lamp; electronic parts for controlling the generation of the high voltage; and a lower case and an upper case for receiving therein the above members, the bulb socket is provided at a neck portion of the high-voltage terminal with a projected part which projects in the widthwise direction, and the projected part has an inclined surface of a tapered shape in which the width gradually increases as seen from the inserting direction of the high-voltage terminal.

In addition, in an ignitor-integral type bulb socket comprising a bobbin which is formed of a resin and around which a primary coil and a secondary coil are wound; a core of high magnetic permeability inserted into the central hole of the bobbin; a high-voltage-side terminal inserted substantially into the central portion of the bobbin and connected to the secondary coil for applying a high voltage to a high-voltage-side plug of the lamp; a low-voltage-side terminal inserted into an outside of the bobbin and connected to a low-voltage-side plug of the lamp; electronic parts for controlling the generation of the high voltage; and a lower case and an upper case for receiving therein the above members, a projected part which projects in the widthwise direction is provided at the neck portion thereof such that the projected part has an inclined surface of a tapered shape in which the width gradually increases as seen from the inserting direction of the high-voltage terminal and that the maximum dimension of the projected part of the high-voltage-side terminal is set large relative to the widthwise dimension of that inserting hole for inserting thereinto the high-voltage-side terminal which is provided in substantially the central portion of the bobbin, at the time the high-voltage-side terminal is forcibly inserted, the inserting hole on the side of the bobbin formed in a resin is expanded in the widthwise direction by the tapered projected part. Since the shoulder of the tapered projected part is formed into an acute angle, the shoulder gets bitten at the bobbin side against any attempt to get out of position made by the high-voltage-side terminal. In this manner, with a simple structure, the high-voltage-side terminal is prevented from getting out of position, thereby securely fixing it to the predetermined position.

As another feature, the following is given.

Namely, in an ignitor-integral type bulb socket comprising a transformer made up of a bobbin which is formed of a resin and around which a primary coil and a secondary coil are wound, a core of high magnetic permeability inserted into the central hole of the bobbin, and a high-voltage-side terminal inserted substantially into the central portion of the bobbin and connected to the secondary coil for applying a high voltage to a high-voltage-side plug of the lamp; a low-voltage-side terminal which is inserted into the outside of the bobbin and connected to a low-voltage-side plug of the lamp; electronic parts for controlling the generation of the high voltage; and a lower case and an upper case for receiving therein the above members, a pushing part is provided at a portion other than the contact claws of the high-voltage-side terminal so that the inserting depth of the high-voltage-side terminal is restricted by an open end surface side of the guide which is formed integrally with the bobbin.

In addition, in an ignitor-integral type bulb socket comprising a bobbin which is formed of a resin and around which a primary coil and a secondary coil are wound; a core of high magnetic permeability inserted into the central hole of the bobbin; a high-voltage-side terminal inserted substantially into the central portion of the bobbin and connected to the secondary coil for applying a high voltage to a high-voltage-side plug of the lamp; a low-voltage-side terminal inserted into the outside of the bobbin and connected to a low-voltage-side plug of the lamp; electronic parts for controlling the generation of the high voltage; and a lower case and an upper case for receiving therein the above members, a pushing part is provided at a portion other than the contact claws of the high-voltage-side terminal so that the inserting depth of the high-voltage-side terminal is restricted by the open end surface side of the guide which is formed integrally with the bobbin, at the time the high-voltage-side terminal is forcibly inserted into the bobbin, the force is applied not to the contact claws but to the urging part. Therefore, the contact claws can be prevented from being deformed. Further, by using the inserting jig having the same plane extending to the urging part of the high-voltage-side terminal and the opening-side end surface of the cylindrical guide of the bobbin, once the high-voltage-side terminal has been inserted into the predetermined depth, the same plane of the jig comes into contact with the side surface on the open end surface of the cylindrical guide which is formed integrally in the central portion of the yoke.

Therefore, the high-voltage-side terminal will not be inserted beyond the predetermined depth. As a result, the end surface on the open-end side of the cylindrical guide and the urging part of the high-voltage-side terminal are restricted to the same height, thereby stably determining the inserting depth of the high-voltage-side terminal.

As another feature, the following is given.

Namely, in an ignitor-integral type bulb socket comprising a transformer made up of a bobbin which is formed of a resin and around which a primary coil and a secondary coil are wound, a core of high magnetic permeability which is inserted into the central hole of the bobbin, and a high-voltage-side terminal inserted substantially into the central portion of the bobbin and connected to the secondary coil for applying a high voltage to a high-voltage-side plug of the lamp; a low-voltage-side terminal inserted into the outside of the bobbin and connected to a low-voltage-side plug of the lamp; electronic parts for controlling the generation of the high voltage; and a lower case and an upper case for receiving therein the above members, the initial winding end of the secondary coil is wound to connect to the terminal of the leg of the high-voltage-side terminal which is inserted substantially into the central portion of the bobbin.

In addition, in an ignitor-integral type bulb socket comprising: a bobbin which is formed of a resin and around which a primary coil and a secondary coil are wound; a core of high magnetic permeability inserted into the central portion of the bobbin; a high-voltage-side terminal inserted substantially into the central portion of the bobbin and connected to the secondary coil for applying a high voltage to a high-voltage-side plug of the lamp; a low-voltage-side terminal inserted into the outside of the bobbin and connected to a low-voltage-side plug of the lamp; electronic parts for controlling the generation of the high voltage; and a lower case and an upper case for receiving therein the above members, by winding the initial winding end of the secondary coil around the terminal of the leg of the high-voltage-side terminal inserted substantially into the central portion of the bobbin, it is not necessary to provide the bobbin with a so-called "binder" which is a hooking projected part for hooking the initial winding end of the coil. In addition, since the coil is directly bound up around the high-voltage-side terminal, the soldering work becomes easier, improving the productivity.

As another feature, the following is given.

Namely, in an ignitor-integral type bulb socket comprising a transformer made up of a bobbin which is formed of a resin and around which are wound a primary coil and a secondary coil, a core of high magnetic permeability inserted into the central hole of the bobbin, and a high-voltage-side terminal inserted substantially into the central portion of the bobbin and connected to the secondary coil for applying a high voltage to a high-voltage-side plug of the lamp; a low-voltage-side terminal inserted into the outside of the bobbin and connected to a low-voltage-side plug of the lamp; electronic parts for controlling the generation of the high voltage; and a lower case and an upper case for receiving therein the above members, the transformer is assembled in the order of the steps of: inserting the leg of the high-voltage-side terminal into the slit-shaped opening provided substantially in the central portion of the bobbin; inserting the core into the hole provided in the central portion of the bobbin; winding the initial winding end of the secondary coil around the leg of the high-voltage-side terminal; winding the secondary coil around the bobbin and thereafter winding the primary coil around the outside layer of the secondary coil.

In addition, in an ignitor-integral type bulb socket comprising a bobbin which is formed of a resin and around which are wound a primary coil and a secondary coil; a core of high magnetic permeability inserted into the central hole of the bobbin; a high-voltage-side terminal inserted substantially into the central portion of the bobbin and connected to the secondary coil for applying a high voltage to a high-voltage-side plug of the lamp; a low-voltage-side terminal inserted into the outside of the bobbin and connected to a low-voltage-side plug of the lamp; electronic parts for controlling the generation of the high voltage; and a lower case and an upper case for receiving therein the above members, by assembling the transformer in the order of the steps of: inserting the leg of the high-voltage-side terminal into the slit-shaped opening provided substantially in the central portion of the bobbin; inserting the core into the hole provided in the central portion of the bobbin; winding the initial winding end of the secondary coil around the leg of the high-voltage-side terminal; winding the secondary coil around the bobbin and thereafter winding the primary coil around the outside layer of the secondary coil, the automatic assembly of the only transformer becomes possible, tremendously improving the production efficiency. Therefore, the cost for the ignitor-integral type lamp socket can be largely reduced.

INDUSTRIAL APPLICABILITY

As described hereinabove, the lamp socket, the lamp transformer, and the method of manufacturing the lamp transformer according to the present invention are applicable to a discharge lamp as a headlight for a mobile body such as a motor vehicle, as a discharge lamp for domestic use, as well as an apparatus for lighting a discharge lamp.

What is claimed is:

1. A transformer for a lamp comprising:

a bobbin around which a coil is wound;

a core which is inserted into said bobbin; and a high-voltage terminal, provided on said bobbin, for connecting said coil and a high-voltage-side contact of said lamp;

wherein a retaining means for retaining said core is provided on said high-voltage terminal.

2. The transformer according to claim 1, wherein said high-voltage terminal comprises:

a lamp terminal which is connected to the lamp;

a core contact which comes into contact with said core inside said bobbin;

a secondary coil connecting part to which a secondary coil is connected;

wherein said core contact of said high-voltage terminal urges said core against a wall surface of said bobbin to retain said core within said bobbin.

3. The transformer according to claim 2, wherein said core contact comprises a projected part.

4. The transformer according to claim 1, wherein said high-voltage terminal comprises a core retaining part, contacted with an open-end surface of at a side where said core gets out of said bobbin, for retaining said core.

5. The transformer according to claim 4, wherein said core retaining part is a bent portion formed by bending an end of said high-voltage terminal toward said core after said high-voltage terminal and said core are assembled into said bobbin.

6. The transformer according to claim 5, wherein said core retaining part is a twisted part formed by twisting an end of said high-voltage terminal after said high-voltage terminal and said core are assembled into said bobbin.

7. A transformer for a lamp comprising:

a bobbin around which a coil is wound;

a core which is inserted into said bobbin;

a high-voltage terminal, inserted into said bobbin, for connecting said coil and a high-voltage-side contact of the lamp; and a projected part, provided at a portion where said high voltage terminal is inserted into said bobbin, and where a surface along an inserting direction is tapered and a corner is provided along a surface opposite to the inserting direction.

8. A transformer for a lamp comprising:

a bobbin around which a coil is wound;

a core inserted which is into said bobbin;

a high-voltage terminal, inserted into said bobbin, for connecting said coil and a high-voltage-side contact of the lamp;

a lamp-side contact, provided on said high-voltage terminal, for coming into contact with a high-voltage side contact of the lamp; and a contact, provided on said high-voltage terminal, and extending further in a direction opposite to the inserting direction of said high-voltage terminal, than said lamp-side contact.

* * * * *